United States Patent [19]

Himberg

[11] 4,446,997

[45] May 8, 1984

[54] CONVERTIBLE CAMERA-SUPPORTING BELT DEVICE

[76] Inventor: Elliot Himberg, 4 Meadow La., Norwich, Conn. 06360

[21] Appl. No.: 461,275

[22] Filed: Jan. 26, 1983

[51] Int. Cl.[3] ..... A45F 5/00

[52] U.S. Cl. ..... 224/151; 224/257; 224/258; 224/269; 224/908

[58] Field of Search ..... 224/257, 258, 269, 908, 224/909, 910, 151, 202; 2/300, 301, 312, 338

[56] References Cited

U.S. PATENT DOCUMENTS

| | | | |
|---|---|---|---|
| 2,817,472 | 12/1957 | Parkhurst | 224/5 |
| 2,822,116 | 2/1958 | Smalley et al. | 224/5 |
| 3,152,738 | 10/1964 | Worsfold, Jr. | 224/5 |
| 3,305,148 | 2/1967 | Zimmerman | 224/5 |
| 3,326,432 | 6/1967 | Banks et al. | 224/909 X |
| 3,920,166 | 11/1975 | Hogensen, Jr. | 224/151 |
| 4,091,974 | 5/1978 | McClintock | 224/5 |
| 4,320,863 | 3/1982 | Lyer et al. | 224/908 X |

*Primary Examiner*—Steven M. Pollard

*Attorney, Agent, or Firm*—Prutzman, Kalb, Chilton & Alix

[57] ABSTRACT

A convertible camera-supporting belt is disclosed for carrying a camera in either a "belt" mode, a "neck sling" mode, a "shoulder strap" mode, or a "hand-holdable" mode. The belt includes a belt strap having a first set of ends connectable by an adjustable buckle to form a belt to be worn about the waist. The belt also includes a second set of ends remote from the first set which are disconnectable to form a shoulder strap or a neck sling. Support elements for hanging a camera are mounted adjacent the second set of ends and are detachably connected to the camera by releasable straps.

17 Claims, 5 Drawing Figures

CONVERTIBLE CAMERA-SUPPORTING BELT DEVICE

BACKGROUND OF THE INVENTION

The present invention relates to a camera-supporting device and more particularly to a camera-supporting belt that is easily convertible to a camera-supporting neck sling or shoulder strap. When carrying a camera during various physical activities such as hiking, climbing, riding, etc., it is desirable to carry the camera in a reasonably secure position against the body rather than dangling from a support sling about the neck. Supporting a relatively heavy object such as a camera around the neck can be uncomfortable, and can be dangerous to the wearer and to the camera when engaging in physical activity.

Various harnesses and straps have been provided for carrying a camera such as Lyer et al U.S. Pat. No. 4,320,863, Worsfold U.S. Pat. No. 3,152,738, Zimmerman U.S. Pat. No. 3,305,148, and McClintock U.S. Pat. No. 4,091,974. Generally, the prior devices required some type of strap around the neck and were conspicuous in appearance. Furthermore, the prior devices were somewhat uncomfortable and physically restrictive, and did not provide significant versatility as to camera carrying position.

It is an object of the present invention to provide a new and improved convertible camera-supporting belt.

A further object of the invention is to provide a convertible camera-supporting device that supports a camera as a belt, a shoulder strap, or neck sling, and which is compact, lightweight, and easily stowable. Included in this object is the provision of such a device in a generally singular strap configuration.

A still further object of the invention is to provide a camera-supporting belt which supports a camera in a reasonably ready and secure position and allows physical activity otherwise prohibited with a neck sling support.

A still further object of the invention is to provide a convertible camera-supporting belt which is adjustable to conform to the physical size of the user either as a belt, shoulder strap, or neck sling.

Another object of the invention is to provide a camera-supporting belt assembly which allows convenient hand carrying of the camera.

Still another object of the invention is to provide a convertible camera-supporting belt which is economical to manufacture, durable in use, and refined in appearance.

Other objects will in part be obvious and in part pointed out more in detail hereinafter.

SUMMARY OF THE INVENTION

It has now been found that the foregoing and related objects and advantages can be readily obtained in a convertible camera-supporting belt which includes a belt strap having a first set of ends connectable by an adjustable buckle to form a belt to be worn around the waist. The belt strap also includes a second set of ends remote from the first set and disconnectable to form the alternative "shoulder strap" and "neck sling" modes of the device. Support elements for hanging a camera from the belt are mounted adjacent the second set of ends. In a preferred embodiment, the support elements include loops connected to the belt and releasable straps detachably connecting the camera to the loops. Further, the connectors for releasably connecting the second set of ends include a button-snap assembly.

DESCRIPTION OF THE PREFERRED EMBODIMENT

Figure 1:
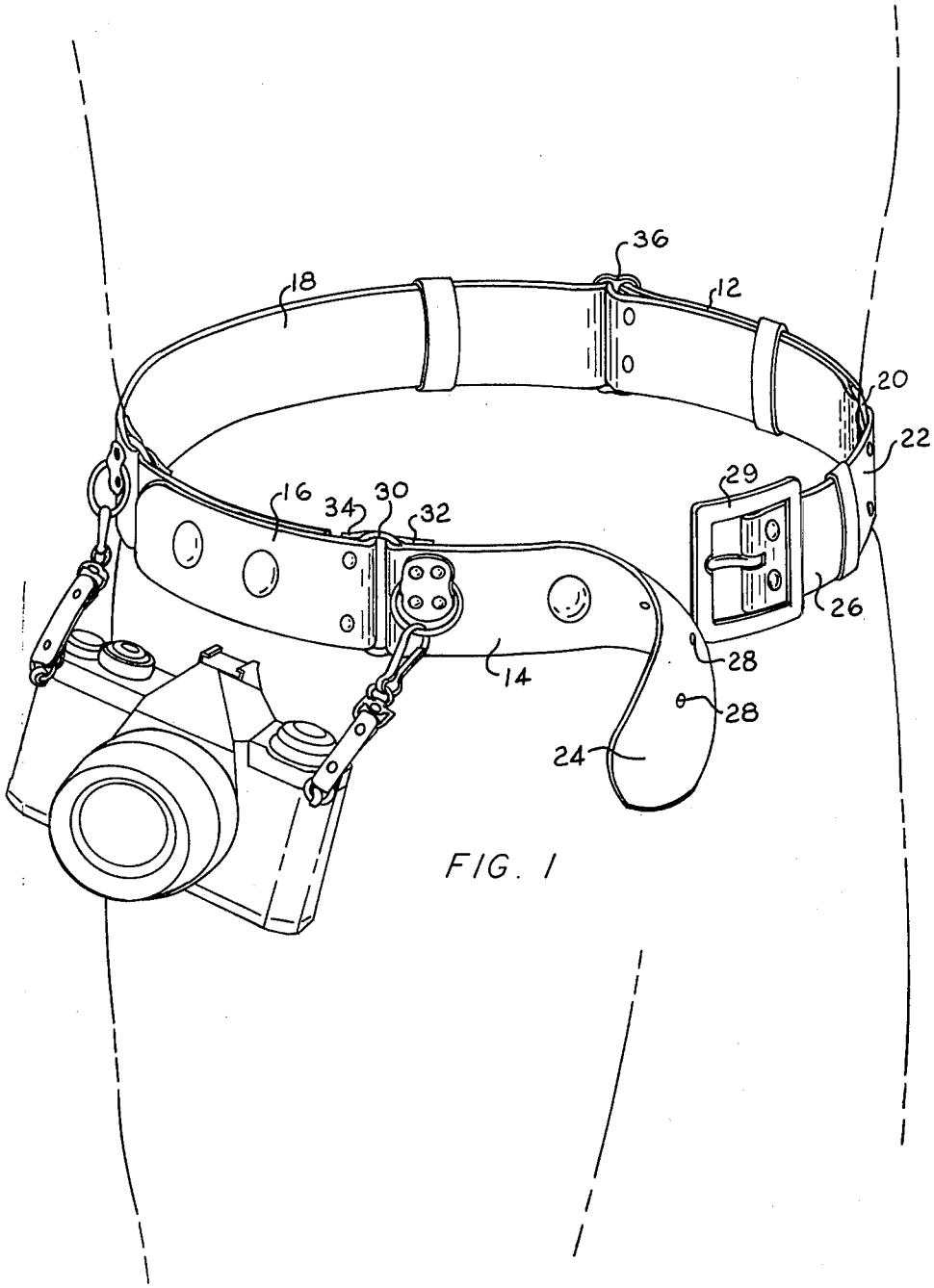
FIG. 1 is a perspective view of the invention in the "belt" mode immediately prior to fastening the belt buckle.

Referring to FIG. 1, the convertible camera-supporting belt of this invention is shown being worn in the "belt" mode, albeit unbuckled. The camera-supporting belt is adaptable to several different modes for carrying a camera which for purposes of explanation are identified as the "belt" mode (FIG. 2), the "neck sling" mode (FIG. 4), the "shoulder strap" mode (which consists of the configuration of FIG. 4 but supported over the shoulder rather than around the neck), and the "hand-holdable" mode (FIG. 5). As will be shown, the belt is adapted for easy conversion to any of these modes.

The camera-supporting belt has a belt strap 12 in the illustrated embodiment generally comprised of interconnected strap segments; namely, belt forming segments 14 and 22, a strap forming segment 16, and an adjustment segment 18. In the illustrated embodiment, the belt forming and adjustment segments present a greater or major circumferential portion of strap 12 as compared to the minor circumferential portion presented by the strap forming segment 16. The strap segments 14, 22 terminate in end portions 24 and 26, respectively, and are adjustably connectable by a buckle 29 fixedly mounted on portion 26. The buckle 29 interlockingly engages the end portion 24 and cooperates with the apertures 28 thereon in a conventional manner.

The adjustment strap segment 18 has a take-up 36 thereon which allows for manual adjustment of the effective length of belt 12 in a conventional manner. The adjustment strap segment 18 is adjustably movable through oval clip 20 and the take-up 36 is slidable along the strap segment 18 to change the effective length of the strap segment 18.

As shown, the strap segment 16 forming the minor circumferential portion is pivotally interconnected with the major portion by oval clips 30 extending through folded back sleeves such as sleeve 32 at one end of the strap segment 14 and the folded back sleeves 34 of the adjacent ends of the strap segment 16. Thus, the strap segment 16 is freely pivotable relative to the remaining major portion of the strap. Other alternative types of pivotal linkage or foldable connections may be utilized.

Figure 2:
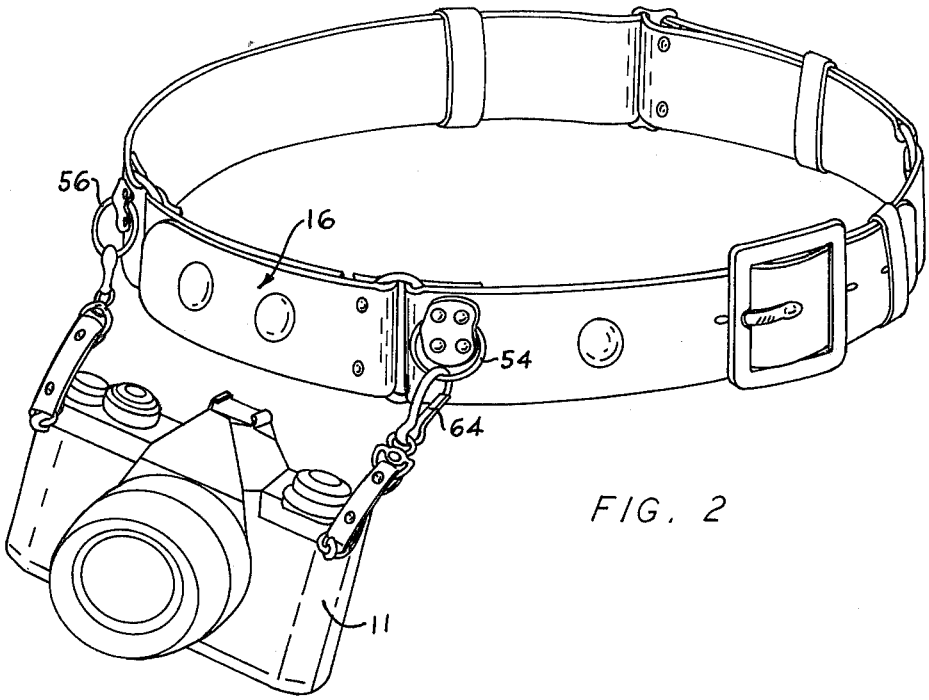
FIG. 2 is similar to FIG. 1 with the belt buckled.
Figure 3:
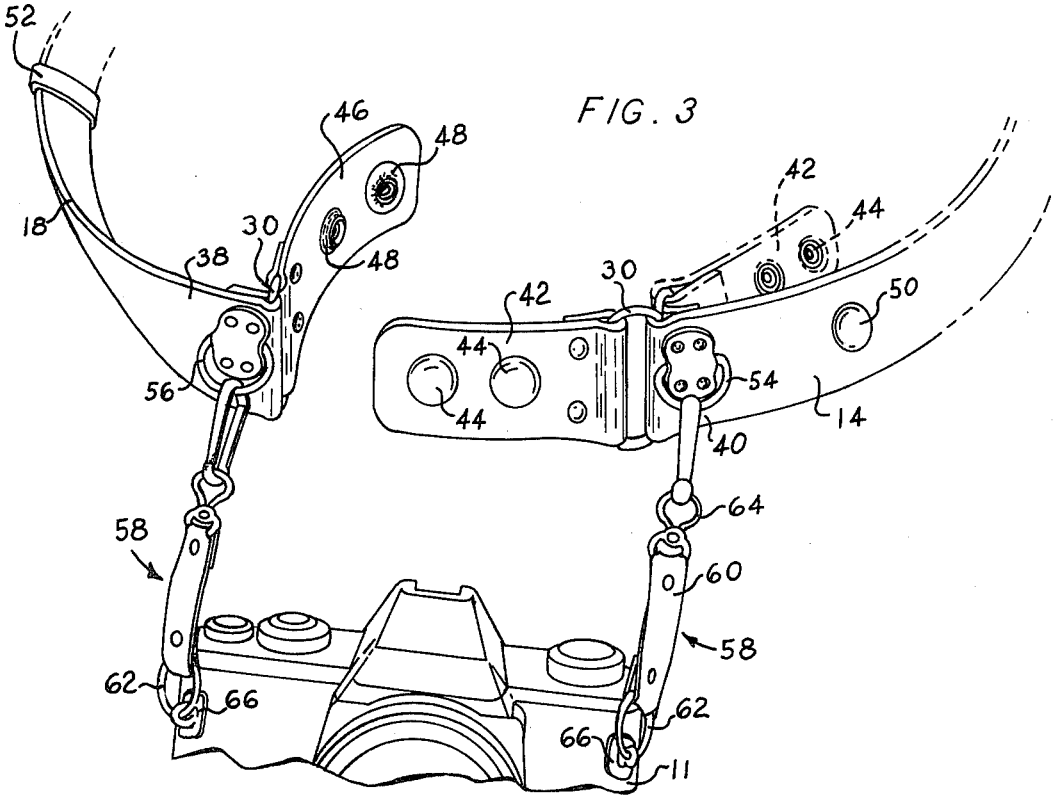
FIG. 3 is a partially broken away perspective view similar to FIG. 2 but with the belt strap separated to convert it to the "neck sling" mode.

Referring to FIG. 3, the strap forming segment 16 is separable so that belt 12 is considered to also have a third end portion 38 and fourth end portion 40 at the oval clips 30. The strap segment 16 is comprised of a first tab 42 having a pair of female button-snaps 44 and a second tab 46 having a complementary pair of male button-snaps 48. The button-snap assembly 44, 48 permits the tabs 42 and 46 to be disconnected to convert the supporting belt from the "belt" mode of FIG. 2 to the "neck sling" mode of FIG. 4. That is, the tabs 42 and 46 are disconnected and the tab 42 is folded back against the strap segment 14 as shown in phantom in FIG. 3. Tab 42 is held fast against strap segment 14 by a male button-snap 50 engaging a female button-snap 44. Similarly, the tab 46 is folded back and held fast against the strap segment 18 by a slide clasp 52 which is slidably mounted along the strap segment 18 and encircles the strap segment 18 and the tab 46. Alternative types of detachable fasteners may be utilized to hold the tabs against the strap segments, e.g., pressure-engageable fastening fabric.

A support loop 54 is securely mounted to end portion 40 and a matching support loop 56 is securely mounted to end portion 38 for hanging the camera 11 therefrom. A pair of handle straps 58 of comparable length releasably connect the camera 11 to the support loops 54 and 56. Each handle strap 58 has a relatively short strap segment 60 with a support ring 62 at one end and a releasable spring clip 64 at the other end. The spring clips 64 releasably interloop with the supporting loops 54 and 56 as shown in FIG. 2. Ringlets, grommets and other types of mounting hardware can be utilized in place of loops 54 and 56.

As is common, camera 11 has mounting rings 66 at opposite ends of the top portion of the camera body. The handle straps 58 are connected to these mounting rings 66 at one end and to the support loops 54 and 56 at the other end. The interconnection of the support rings 62 and the mounting rings 66 and the interconnection of the spring clips 64 and the support loops 54 and 56 allow a degree of free-swinging pivotal movement of the camera 11 relative to the belt strap 12. Thus, the camer 11 is supported in a generally horizontal orientation when the support belt is arranged in the "belt" mode as shown in FIG. 1.

Figure 4:
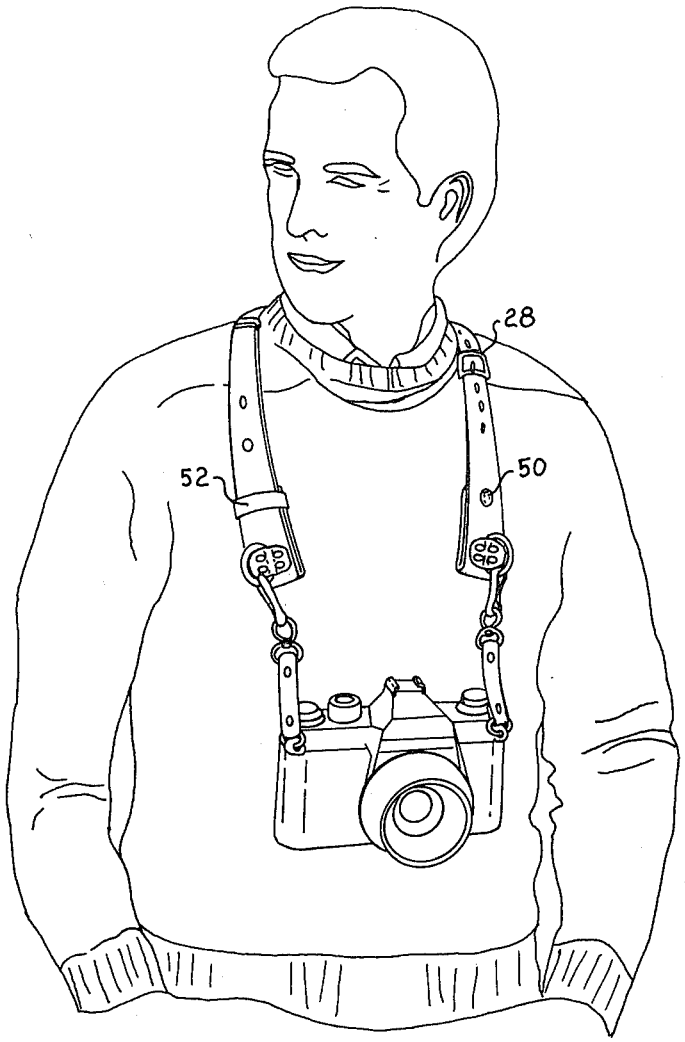
FIG. 4 is a perspective view of the invention being worn in the "neck sling" mode.
Figure 5:
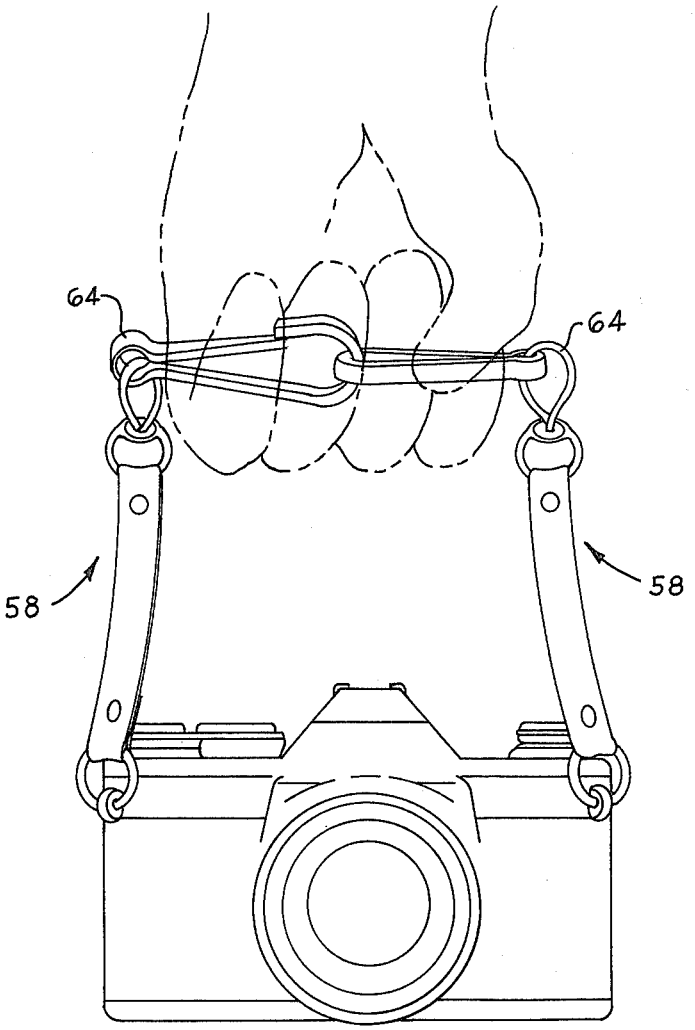
FIG. 5 is an enlarged perspective view of the invention in a "hand-holdable" mode.

Referring to FIG. 4, the camera-supporting belt is arranged in the "neck sling" mode wherein the buckle 29 remains interlocked with the end portion 24. The tabs 42 and 46 are disconnected and folded back against the strap segments 14 and 18 respectively and affixed thereto. Again, the swivel or pivotal connection between the camera 11 and the support belt allows the camera to freely seek a horizontal orientation which is desirable for quick action photography.

For the "shoulder strap" mode, the supporting belt is arranged in the configuration of FIG. 4. However, the belt strap would be slung over a shoulder rather than encircling the wearer's neck.

Referring to FIG. 5, the handle straps 58 have been detached from the support loops 54 and 56 and the two spring clips 64 are interconnected to form the "hand-holdable" mode. The handle straps 58 are of sufficient length to form a handle grip as shown in FIG. 5 and this mode allows a safe convenient handling of a camera when a body support is not desired.

In operation, the support belt is worn in the "belt" mode as shown in FIG. 2 when physical movement is anticipated and it is not necessary to maintain the camera in a quick-action ready position. Although the camera is free to move somewhat, the relatively short length of the handle straps 58 assure that it will be maintained close to the body. Being supported on a belt, fatigue is not a serious consideration and the camera is not free to swing around so as to incur damage or cause injury. To take a picture, the camera may be released from the belt by disconnecting the spring clips 64 from the support loops 54, 56 or by converting the belt to another mode.

Should it be desired to support the camera in a more ready position as shown in FIG. 4, the button-snap assembly 44, 48 is disconnected so as to separate the tabs 42 and 46. The tab 42 is folded back against the strap segment 14 and affixed thereto by interconnecting the female button-snap 44 and the male button-snap 50. The tab 46 is folded back against the strap segment 18 and affixed thereto by sliding the clasp 52 over the tab 46. The support belt can then be worn as a "neck sling" as shown in FIG. 4. The camera 11 is thus supported in a generally horizontal position and is easily moveable for action photography. Additionally, the support belt can be slung over the shoulder to carry the camera in the "shoulder strap" mode.

Adjustment of the effective length of the belt for either utilization in the "belt" mode or in the "neck sling" mode is easily accomplished by sliding the take-up 36 along strap 12 in a known manner. Thus, the camera-supporting belt strap is of universal size to accommodate all users.

Should it be desired to support the camera in a "hand-holdable" position without a support belt, the handle straps 58 are easily detached from the belt 12 and connected together to form a convenient handle grip for the camera 11 as shown in FIG. 5. This allows the camera to be supported without an elongated strap, yet guard against being dropped.

The support belt is preferably made of strong, durable, and relatively lightweight material. It is compact and easily stowable by folding or coiling.

Thus, it can be seen that this device accomplishes at least all of its stated objectives.

I claim:

1. A convertible multi-function camera-supporting belt for alternate, exclusive utilization solely as either a belt worn about the waist, or a strap worn about the neck or over the shoulder, comprising:

a belt strap having first and second sets of interconnecting ends adapted to be connectable to form an encircling belt, said strap being of sufficient length to be worn around the waist of a human, with no portion or apendage thereof simultaneously engaging the back of the user both above and below the shoulders of the user, buckle means for adjustably securing said first set of ends together to form said waist encircling belt, the ends of said second set being remote from the ends of said first set by a distance sufficient to place said second set adjacent one hip of the user when the belt is worn about the waist, said second set being adapted to be disconnectable to form a shoulder strap and alternatively to form a neck sling means for releasably connecting the ends of said second set together, and means for supportively hanging a camera from said belt strap adjacent the ends of said second set.

2. The device of claim 1 wherein said means for supportively hanging a camera from said belt includes means for hanging a camera in a horizontal orientation relative to said belt.

3. The device of claim 1 wherein said means for supportively hanging a camera comprises:

a first loop connected to said belt adjacent one end of said second set, a second loop connected to said belt adjacent the other end of said second set, a first means for releasably connecting a camera to said first loop, and a second means for releasably connecting a camera to said second loop.

4. The device of claim 3 wherein said first means comprises a first strap having one end releasably mountable to a camera and a spring clip at the other end for detachable connection to said first loop, and said second means comprises a second strap having one end releasably mountable to a camera and a spring clip at the other end for detachable connection to said second loop.

5. The device of claim 4 wherein said spring clip of said first strap is attachable to said spring clip of said second strap and said support straps are of sufficient length to form a hand-holdable support strap.

6. The device of claim 4 wherein said first and second straps are of comparable length and said first strap is mountable to the top of a camera at one end and said second strap is mountable to the top of a camera at the other end whereby the camera is supported in a horizontal orientation when the belt strap is worn about the waist.

7. The device of claim 1 wherein said means for releasably connecting the ends of said second set together includes a button-snap assembly.

8. The device of claim 1 wherein said means for releasably connecting the ends of said second set together comprises a first tab pivotally positioned at one end of said second set, a second tab pivotally positioned at the other end of said second set, and a button-snap assembly releasably interconnecting said first and second tabs.

9. The device of claim 8 including means for releasably securing said first tab folded back against said belt strap and for releasably securing said second tab folded back against said belt strap when said tabs are disconnected.

10. The device of claim 9 wherein said securing means comprises a button-snap assembly.

11. The device of claim 9 wherein said securing means comprises a clasp encompassing said belt strap and slidable over said folded back tab.

12. The device of claim 1 further comprising means for selectively adjusting the effective length of said belt strap.

13. A convertible multi-function camera-supporting strap for alternate, exclusive utilization solely as either a belt worn about the waist, or a strap worn around the neck or over the shoulder, comprising:

a belt of sufficient length to encircle the waist of a human, having a major circumferential portion adapted for detachable mounting about the waist and a contiguous minor circumferential portion operatively associated therewith to form an encircling belt, with no portion or apendage thereof simultaneously engaging the back of the user both above and below the shoulders of the user, a pair of camera supporting mounts connected to said belt strap at opposite ends of the major portion for, supporting a camera on the hip of the user when the strap is worn about the waist, and means for disconnecting said minor portion between said camera supporting mounts to form a neck strap for a camera attached to said camera supporting mounts.

14. The device of claim 13 further comprising means for supportively hanging a camera from said camera supporting mounts.

15. The device of claim 14 wherein, said camera supporting mounts comprise first and second loops connected to said belt strap, and said supporting means comprises first and second straps each having one end releasably mountable to a camera and a spring clip at the other end for detachable connection to a respective loop.

16. The device of claim 13 wherein said disconnecting means comprises a releasable button-snap assembly.

17. The device of claim 13 wherein, said minor circumferential portion comprises first and second releasably connected tabs, said first tab being pivotally connected to one end of said major portion and said second tab being pivotally connected to the other end of said major portion, and said disconnecting means comprises a means for detachably fastening said first tab to said second tab.

* * * * *